US005814125A

United States Patent [19]

Anderson et al.

[11] Patent Number: 5,814,125

[45] Date of Patent: Sep. 29, 1998

[54] METHOD FOR INTRODUCING GAS INTO A LIQUID

[75] Inventors: John Erling Anderson, Somers; Pravin Chandra Mathur, Bronx; Ronald Joseph Selines, North Salem, all of N.Y.

[73] Assignee: Praxair Technology, Inc., Danbury, Conn.

[21] Appl. No.: 819,810

[22] Filed: Mar. 18, 1997

[51] Int. Cl.[6] ..... C22B 9/05

[52] U.S. Cl. ..... 75/414; 75/530; 75/708; 75/711

[58] Field of Search ..... 75/553, 530, 711, 75/708; 266/225

[56] References Cited

U.S. PATENT DOCUMENTS

| | | | |
|---|---|---|---|
| 3,427,151 | 2/1969 | Koudelka et al. | 75/530 |
| 4,210,442 | 7/1980 | Lewis, III et al. | 75/60 |
| 4,373,949 | 2/1983 | Spruell et al. | 75/60 |
| 4,426,224 | 1/1984 | Shimme et al. | 266/225 |
| 4,599,107 | 7/1986 | Masterson | 75/59.2 |
| 5,302,325 | 4/1994 | Cheng | 261/76 |
| 5,569,180 | 10/1996 | Spears | 422/45 |

OTHER PUBLICATIONS

Stoecker et al., "Fundamental Concepts of Oxygen Cutting", Welding Journal, pp. 151–s–156–s (1957). Month Unavailable.

*Primary Examiner*—Melvyn Andrews
*Attorney, Agent, or Firm*—Stanley Ktorides

[57] ABSTRACT

A method for introducing gas into a liquid wherein a gas stream is ejected from a lance spaced above the liquid surface and directed from the lance onto the liquid surface. The gas retains substantially all its original jet axis velocity when it contacts the liquid surface, and substantially all of the gas penetrates the liquid surface and is introduced into the liquid. Preferably the gas stream is surrounded by a flame envelope running from the lance to the liquid surface, which shields the gas from ambient gas entrainment. The gas stream preferably forms a gas cavity within the liquid having a diameter substantially the same as the diameter of the gas stream as it is ejected from the lance.

17 Claims, 5 Drawing Sheets

METHOD FOR INTRODUCING GAS INTO A LIQUID

TECHNICAL FIELD

This invention relates generally to gas flow and particularly to gas flow into a liquid. The invention is especially useful for introducing gas into a liquid, such as molten metal, which creates a harsh environment for the gas injection device.

Background Art

Gases may be injected into liquids for one or more of several reasons. A reactive gas may be injected into a liquid to react with one or more components of the liquid, such as, for example, the injection of oxygen into molten iron to react with carbon within the molten iron to decarburize the iron and to provide heat to the molten iron. Oxygen may be injected into other molten metals such as copper, lead and zinc for smelting purposes. A non-reactive gas, such as an inert gas, may be injected into a liquid to stir the liquid in order to promote, for example, better temperature distribution or better component distribution throughout the liquid.

Often the liquid is contained in a vessel such as a reactor or a melting vessel wherein the liquid forms a pool within the vessel conforming to the bottom and some length of the sidewalls of the vessel, and having a top surface. When injecting gas into the liquid pool, it is desirable to have as much gas as possible flow into the liquid to carry out the intent of the gas injection. Accordingly gas is injected from a gas injection device into the liquid below the surface of the liquid. If the nozzle for a normal gas jet were spaced some distance above the liquid surface, then much of the gas impinging on the surface will be deflected at the surface of the liquid and will not enter the liquid pool. Moreover such action causes splashing of the liquid which can result in loss of material and in operating problems.

Submerged injection of gas into liquid using bottom or side wall mounted gas injection devices, while very effective, has operation problems when the liquid is a corrosive liquid or is at a very high temperature, as these conditions can cause rapid deterioration of the gas injection device and localized wear of the vessel lining resulting in both the need for sophisticated external cooling systems and in frequent maintenance shut-downs and high operating costs. One expedient is to bring the tip or nozzle of the gas injection device close to the surface of the liquid pool while avoiding contact with the liquid surface and to inject the gas from the gas injection device at a high velocity so that a significant portion of the gas passes into the liquid. As an example, a water cooled lance in an electric arc furnace typically produces a jet with a velocity of about 1500 feet per second (fps) and is positioned between 6 and 12 inches above the surface of the liquid steel bath. However, this expediency is still not satisfactory because the proximity of the tip of the gas injection device to the liquid surface may still result in significant damage to this equipment. Moreover, in cases where the surface of the liquid is not stationary, the nozzle would have to be constantly moved to account for the moving surface so that the gas injection would occur at the desired location and the required distance between the lance tip and bath surface would be maintained. For electric arc furnaces, this requires complicated hydraulically driven lance manipulators which are expensive and require extensive maintenance.

Another expedient is to use a pipe which is introduced through the surface of the liquid pool. For example, non-water cooled pipes are often used to inject oxygen into the molten steel bath in an electric arc furnace. However, this expediency is also not satisfactory because the rapid wear of pipe requires complicated hydraulically driven pipe manipulators as well as pipe feed equipment to compensate for the rapid wear rate of the pipe. Moreover, the loss of pipe, which must be continuously replaced, is expensive.

Accordingly, it is an object of this invention to provide a method for introducing gas into a liquid pool wherein essentially all of such gas ejected from the gas injection device enters the liquid pool, without need for submerged injection of the gas into the liquid while avoiding significant damage to the gas injection device caused by contact with or proximity to the liquid pool.

SUMMARY OF THE INVENTION

The above and other objects, which will become apparent to one skilled in the art upon a reading of this invention, are attained by the present invention which is:

A method for introducing gas into a liquid pool comprising:

(A) ejecting gas from a lance having a nozzle with an exit diameter (d) and having a tip spaced from the surface of the liquid pool, and forming a gas stream having an initial jet axis velocity upon ejection from the lance tip;

(B) passing the gas stream from the lance tip to the liquid pool surface through a distance of at least 20d, and contacting the liquid pool surface with the gas stream having a jet axis velocity of at least 50 percent of the initial jet axis velocity; and (C) passing gas from the gas stream through the surface of the liquid pool and into the liquid pool.

As used herein the term "lance" means a device in which gas passes and from which gas is ejected.

As used herein the term "jet axis" means the imaginary line running through the center of the jet along its length.

As used herein the term "jet axis velocity" means the velocity of a gas stream at its jet axis.

As used herein the term "lance tip" means the furthest extending operational part of the lance end from which gas is ejected.

As used herein the term "flame envelope" means a combusting stream substantially coaxial with the main gas stream.

As used herein the term "oxygen" means a fluid which has an oxygen concentration about equal to or greater than that of air. A preferred such fluid has an oxygen concentration of at least 30 mole percent, more preferably at least 80 mole percent. Air may also be used.

Figure 2:
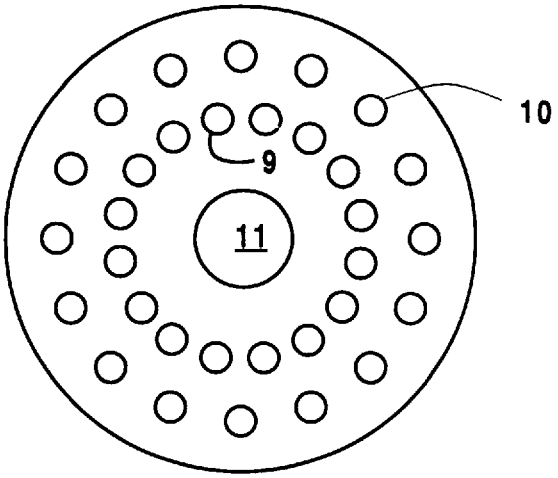
FIGS. 1 and 2 are detailed views of one embodiment, FIG. 1 being a cross sectional view and FIG. 2 being a head-on view, of the lance tip or lance injection end useful in the practice of this invention.

The numerals in the Figures are the same for the common elements.

DETAILED DESCRIPTION

The invention comprises the ejection of gas from a lance tip spaced from the surface of a liquid pool, which comprises, for example, molten metal or an aqueous liquid, and the passage of that gas into the liquid pool. The lance tip is spaced from the liquid pool surface by a large distance, such as two feet or more. The gas is ejected from the lance through a nozzle having an exit diameter(d) and the lance tip is spaced from the liquid pool surface by a distance along the jet axis of at least 20d. Despite this large distance, very little of the gas is deflected by the liquid pool surface Substantially all of the gas which is ejected from the lance tip passes through the surface of the liquid pool and into the liquid pool. In the practice of this invention, generally at least 70 percent and typically at least 85 percent of the gas ejected from the lance passes through the surface of the liquid pool and into the liquid pool. This benefit, which enables the lance tip to avoid substantial wear, is achieved by providing the gas stream which is formed upon ejection from the lance tip with an initial jet axis velocity and preserving that jet axis velocity substantially intact as the gas stream passes from the lance tip to the liquid pool surface. That is, the gas stream which is formed upon ejection from the lance tip is provided with an initial momentum which is preserved substantially intact within the original gas stream or jet diameter as the gas stream passes from the lance tip to the liquid pool surface. Generally the jet axis velocity of the gas stream when it contacts the liquid pool surface will be at least 50 percent and preferably will be at least 75 percent of the initial jet axis velocity. Generally in the practice of this invention the jet axis velocity of the gas stream when it impacts the liquid surface will be within the range of from 500 to 3000 fps.

Any means for preserving the jet axis velocity of the gas stream substantially intact from the ejection from the lance tip to the contact with the liquid pool surface may be employed in the practice of this invention. One preferred method for so preserving the jet axis velocity of the gas stream is by surrounding the gas stream with a flame envelope, preferably one which extends substantially from the lance tip to the surface of the liquid pool. The flame envelope generally has a velocity which is less than the jet axis velocity of the gas stream which, in this embodiment, is termed the main gas stream. The flame envelope forms a fluid shield or barrier around the main gas stream. This barrier greatly reduces the amount of ambient gases being entrained into the main gas stream.

In conventional practice, as a high velocity fluid stream passes through air or some other atmosphere, gases are entrained into the high velocity stream causing it to expand in a characteristic cone pattern. By action of a slower moving flame envelope barrier, this entrainment is greatly reduced. Preferably the flame envelope shields the main gas stream immediately upon ejection of the main gas from the lance tip, i.e. the flame envelope is attached to the lance tip, and, most preferably, the flame envelope extends unbroken to the liquid pool surface so that the flame envelope actually impinges upon the liquid pool surface.

The gas is ejected from the lance tip through a nozzle having an exit diameter(d) which is generally within the range of from 0.1 to 3 inches, preferably within the range of from 0.5 to 2 inches. The lance tip is spaced from the surface of the liquid pool such that the gas passes from the nozzle to the liquid pool through a distance of at least 20d and may be passed through a distance of up to 100d or more. Typically the lance tip is spaced from the surface of the liquid pool such that the gas passes from the nozzle to the liquid pool through a distance within the range of from 30d to 60d. The preservation of the jet axis velocity from the lance nozzle to the surface of the liquid pool enables the gas stream to retain substantially all its momentum within a cross sectional area that is substantially equal to that of the nozzle exit area throughout this distance, thus enabling essentially all of the gas to penetrate the surface of the liquid as if the lance tip were positioned right above the surface.

Not only does substantially all of the gas exiting the lance penetrate into the liquid, but also the penetration into the liquid pool is deeper, generally by a factor of 2 to 3, than that possible without the practice of the invention for any given distance between the lance and the liquid surface and for any given gas stream velocity. This deep penetration enhances the reaction and/or stirring effect of the gas passed into the liquid. Indeed, in some cases the gas penetrates so deeply into the liquid before buoyancy forces cause it to turn back up, that the gas action within the liquid mimics the action of subsurface injected gas.

Any effective gas may be used to form the gas stream in the practice of this invention. Among such gases one can name nitrogen, oxygen, argon, carbon dioxide, hydrogen, helium, steam and hydrocarbon gases such as methane and propane. Mixtures of two or more gases may also be used as the gas to form the gas stream in the practice of this invention. Natural gas and air are two examples of such mixtures which may be used. The gas is ejected from the lance at a high initial jet axis velocity, generally at least 1000 fps and preferably at least 1500 fps. In a preferred embodiment of the invention the gas stream has a supersonic initial jet axis velocity and also has a supersonic jet axis velocity when it contacts the liquid pool surface.

The flame envelope which surrounds the main gas stream in the preferred embodiment of the invention may be formed in any effective manner. For example, a mixture of fuel and oxidant may be ejected from the lance in an annular stream coaxial with the main gas stream and ignited upon exiting the lance. Preferably the fuel and oxidant are ejected from the lance in two streams each coaxial with the main gas stream and these two streams mix and combust as they flow from the lance. Preferably the fuel and oxidant are ejected from the lance through two rings of holes surrounding the main gas jet at the lance axis. Usually the fuel is supplied to the inner ring of holes and oxidant is supplied to the outer ring of holes. The fuel and oxidant exiting the two rings of holes mix and combust. An embodiment of this preferred arrangement is illustrated in FIGS. 1–3.

Figure 1:
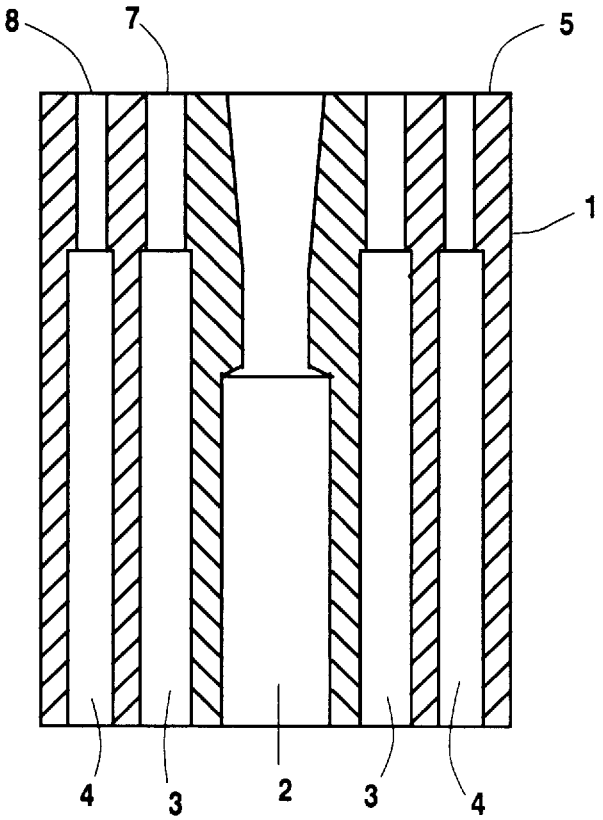
Figure 3:
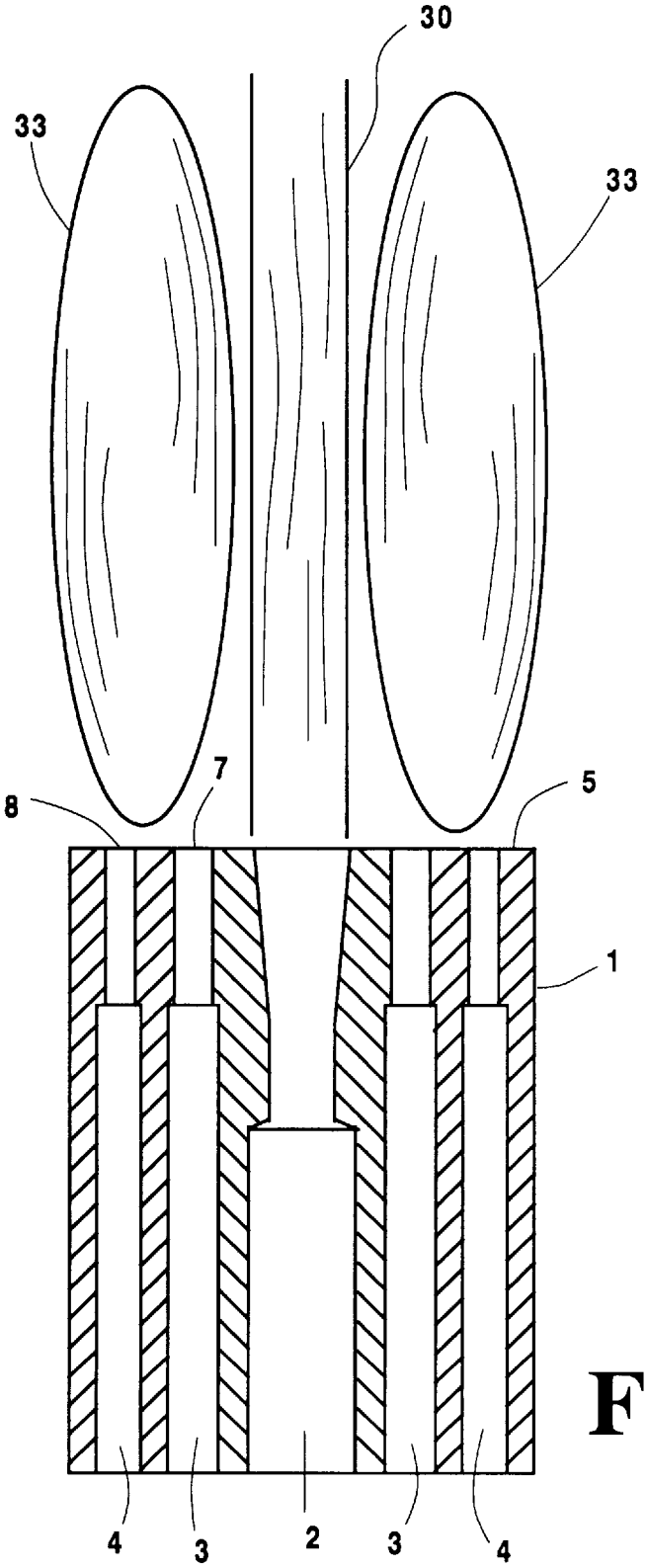
FIG. 3 illustrates in cross section one embodiment of a lance tip, the passage out from the lance tip of the main gas to form the main gas stream, and the formation of the flame envelope in one preferred practice of the invention.

Referring now to FIGS. 1–3, there is illustrated lance 1 having a central conduit 2, a first annular passageway 3 and a second annular passageway 4, each of the annular passageways being coaxial with central conduit 2. Central conduit 2 terminates at injection end 5 or tip of lance 1 to form a main orifice 11. The first and second annular passageways also terminate at the injection end. The first and second annular passageways may each form annular orifices 7, 8 around the main orifice or may terminate in sets of first and second injection holes 9 and 10 arranged in a circle around the main orifice. Central conduit 2 communicates with a source of main gas (not shown). Second annular passageway 4 communicates with a source of oxygen (not shown). First annular passageway 3 communicates with a source of fuel (not shown). The fuel may be any fuel, preferably a gaseous fuel and most preferably is natural gas or hydrogen. In an alternative embodiment the fuel may be passed through the lance in the outermost annular passageway and the secondary oxygen may be passed through the lance in the inner annular passageway. Preferably, as illustrated in FIG. 1, the nozzle 50 used to eject the gas from the lance is a converging/diverging nozzle.

The main gas is ejected out from lance 1 and forms main gas stream 30. Fuel and oxidant are ejected out lance 1 and form annular streams which begin mixing immediately upon ejection from lance 1 and combust to form flame envelope 33 around main gas stream 30 which extends from the lance tip for the length of coherent main gas stream 30. If the invention is employed in a hot environment such as a metal melting furnace, no separate ignition source for the fuel and oxidant is required. If the invention is not employed in an environment wherein the fuel and oxidant will auto ignite, an ignition source such as a spark generator will be required. Preferably the flame envelope will have a velocity less than the jet axis velocity of the main gas stream and generally within the range of from 50 to 500 fps.

Figure 4:
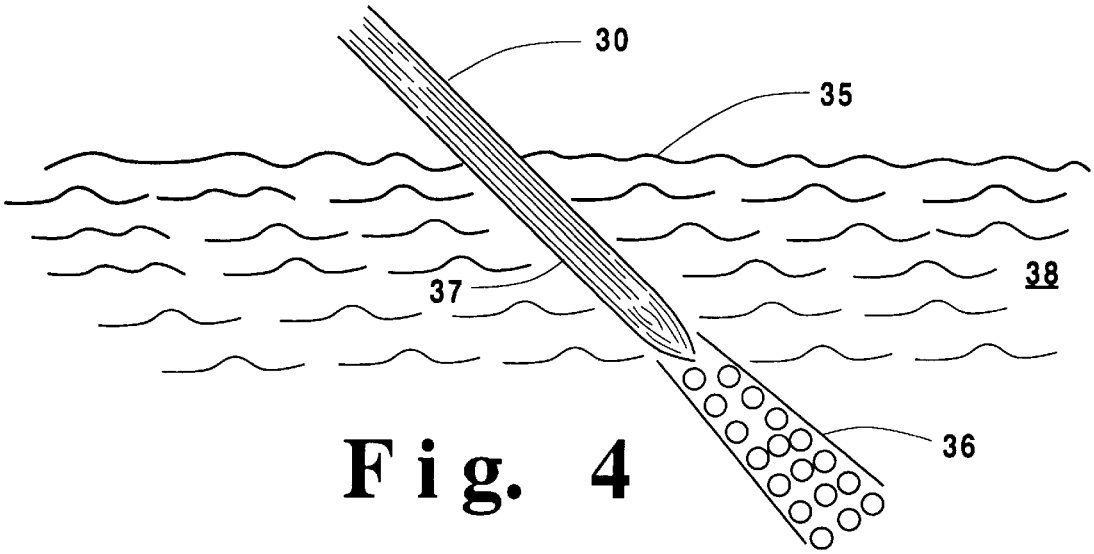
FIG. 4 illustrates one embodiment of the introduction of gas into liquid in the practice of the invention.

Referring to FIG. 4, high velocity coherent main gas jet 30 impacts the surface 35 of the liquid and penetrates deep into the liquid forming a gas cavity 37 within the liquid. The gas cavity 37 has substantially the same diameter as does the gas jet 30 when it is ejected from the lance. After the gas jet penetrates into the liquid pool 38 for some distance below the liquid pool surface 35 within gas cavity 37, the gas jet breaks up into bubbles 36 which continue for some further distance into the liquid and then dissolve into the liquid. Depending on whether the gas is a reactive or an inert gas, these bubbles subsequently dissolve or react with the liquid or rise to the surface due to buoyancy forces.

Figure 7:
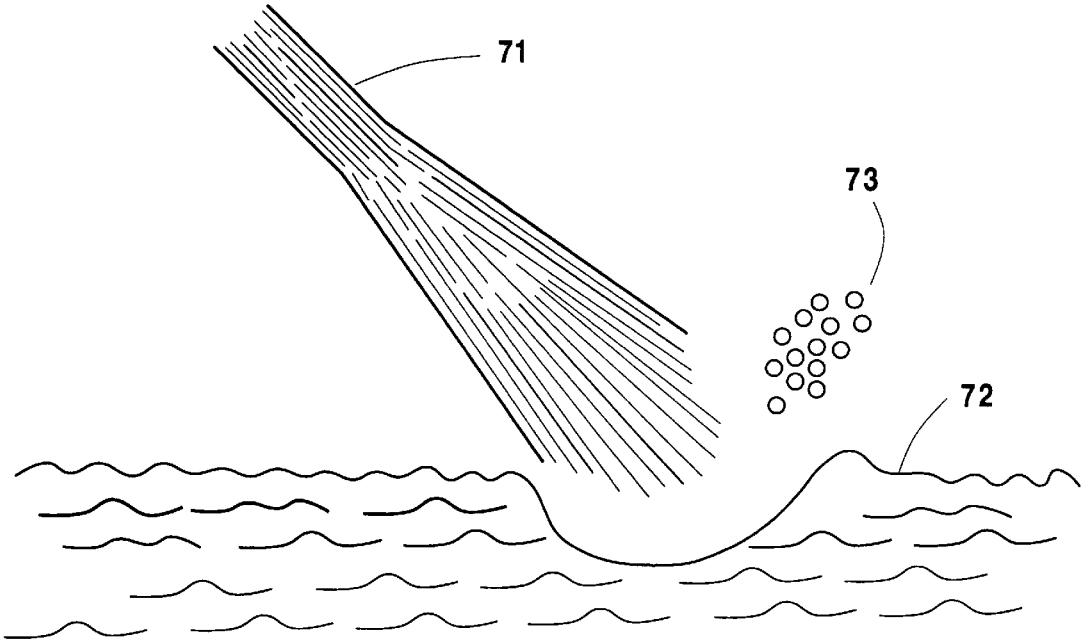
FIG. 7 illustrates, for comparative purposes, conventional practice wherein a gas jet is used to introduce gas into a liquid from above the surface of the liquid.

For comparative purposes FIG. 7 illustrates what happens when a conventional jet 71 impacts the surface 72 of a liquid pool. Not only is there not formed a deep penetration cavity, but also there is generated a significant amount of liquid spray 73.

Generally the amount of fuel and oxidant provided from the lance will be just enough to form an effective flame envelope for the desired length of the main gas stream. However there may be times when it is desired that significantly more fuel and oxidant is passed out from the lance so that the flame envelope not only serves to shield the main gas stream from entrainment of ambient gas, but also serves to provide significant heat into the volume above the top surface of the liquid pool. That is, the lance may, in some embodiments of this invention, function also as a burner.

Figure 5:
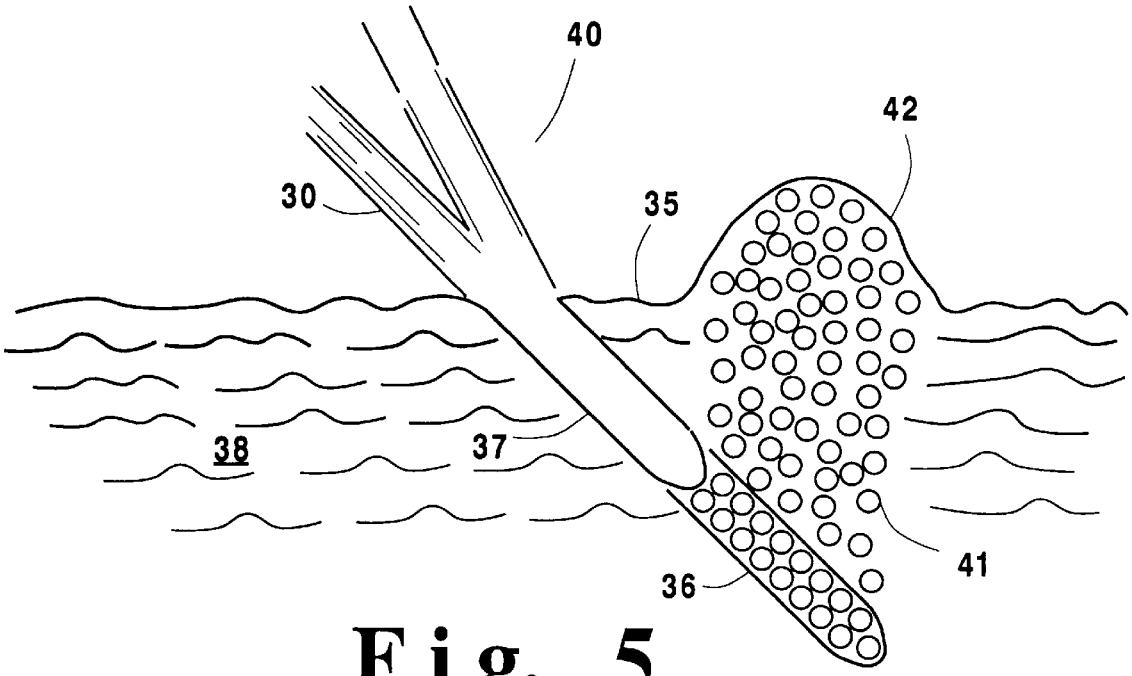
FIG. 5 illustrates another embodiment of the invention wherein the invention is employed to introduce solid and/or liquid particles along with gas into liquid.

In some instances it may be desirable to provide liquid and/or solid particulate material into the liquid pool along with gas. This would allow the effective addition of additives or reagents in powder form and eliminate the need for current methods and equipment for powder injection into iron and steel such as refractory coated lances which wear out and are expensive or cored wire which is also expensive. FIG. 5 illustrates one example of this embodiment of the invention wherein a liquid stream or a gaseous stream containing liquid and/or solid particles, shown as stream 40 in FIG. 5, annularly contacts main gas stream 30 slightly above the surface 35 of the liquid pool 38 and is passed with the main gas stream into the liquid pool. Alternatively, stream 40 could contact jet 30 close to where it is ejected from lance 1 and the liquid and/or solid material would envelope the gas jet and be passed as such into the liquid. In FIG. 5 there is also illustrated the rise of gas bubbles 41 in the liquid pool after passing into the liquid from gas cavity 37, and mound 42 on the surface of the liquid formed by the plume of rising bubbles 41 as it disengages from the liquid bath.

The formation of mound 42 is due to the forces that result from the buoyancy driven upward flow of the bubbles which drags liquid into the disengagement zone above the plane at which the surface of the liquid zone would normally lie. This rising plume of bubbles and subsequent formation of mound 42 provides effective mixing of the bulk liquid pool as well as effective mixing of the liquid with any separate component which may be present as a layer on top of the liquid.

Figure 6:
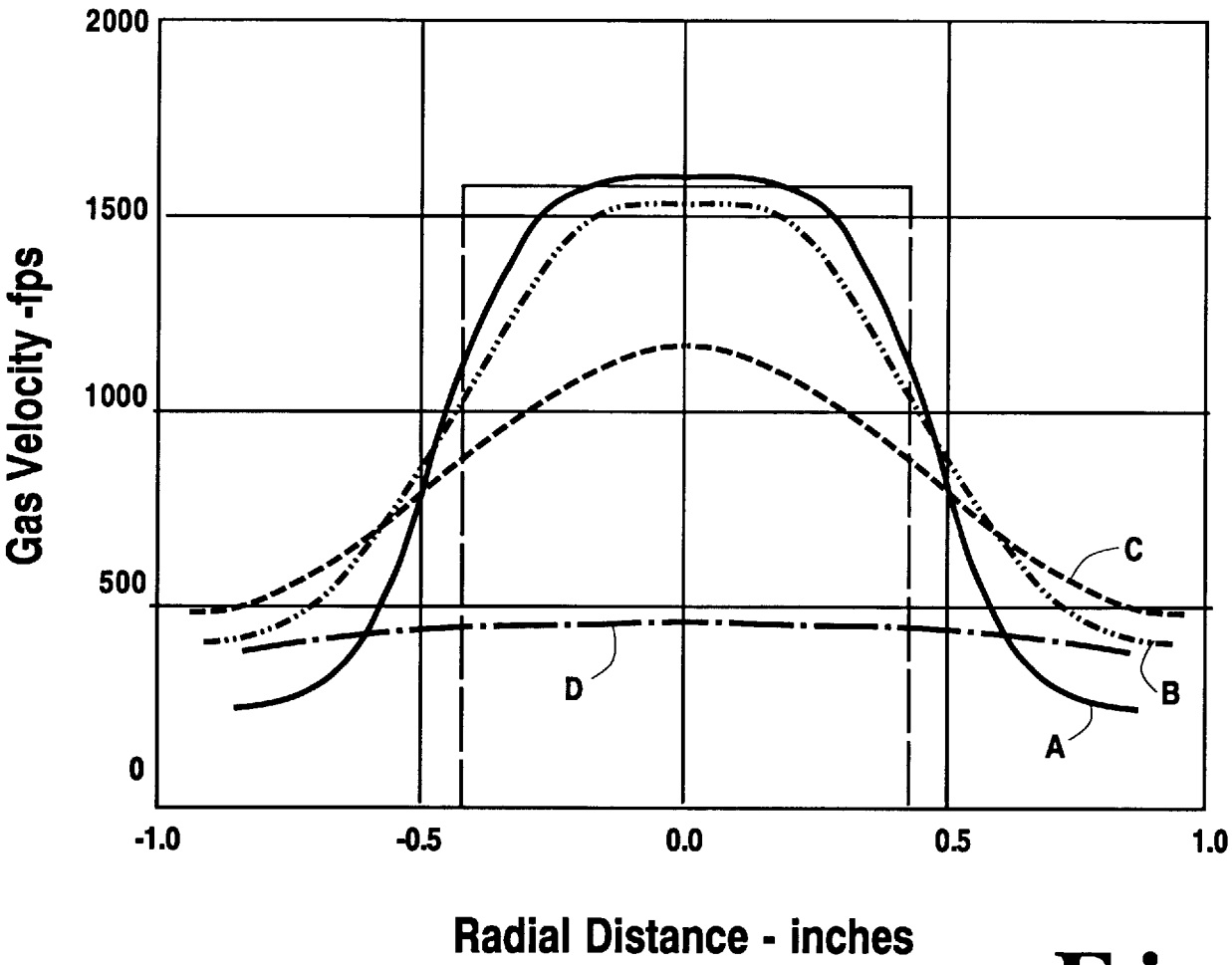
FIG. 6 is a graphical representation of experimental results showing gas stream jet axis velocity preservation in the practice of this invention.

FIG. 6 presents in graphical form experimental results achieved with the practice of the invention.

Experimental tests were carried out using apparatus similar to that illustrated in FIGS. 1–3. Pitot tube measurements were carried out at distances of 2, 3 and 4 feet from the injection point to simulate liquid pool surface impact. The results are shown in FIG. 6 wherein curves A, B and C show results using the coherent gas jet of the invention at distances of 2, 3 and 4 feet respectively, and curve D shows the results obtained at 2 feet with a conventional gas jet stream. For the test results given in FIG. 6, the main gas was oxygen flowing at 42,000 CFH (measured at 60 deg F and 1 atm pressure). The oxygen passed through a supersonic converging diverging nozzle with a 0.671" throat diameter and a 0.8721" diameter exit. Natural gas (3000 CFH) passed through an annulus to a ring of 16 holes, 0.154" diameter, on a 2" diameter circle. The secondary oxygen (5000 CFH) passed through an annulus to a ring of 16 holes, 0.199" diameter, on a 2¾" diameter circle. Pitot tube pressure measurements, which could be used to determine the gas velocity and temperature, were made at several points within the jet. In FIG. 6, the velocity is plotted versus radial distance from the nozzle centerpoint for nozzle-to-probe distances of 2, 3 and 4 feet for jets with the flame envelope and for a distance of 2 feet for a normal jet without the flame envelope. In addition, the calculated velocity profile at the nozzle exit is indicated by the dashed line. With the practice of this invention, the velocity remained essentially constant at the axis for distances of 2 and 3 feet. There was a decrease in the velocity at the axis at 4 feet but the flow was still supersonic. Within the original diameter of the nozzle (0.872"), the velocities were all supersonic up to 4 feet from the nozzle. By comparison, at 2 feet from the nozzle, the velocity profile for the conventional jet was subsonic with a relatively wide, flat profile.

The following example of the invention is presented for illustrative purposes and is not intended to be limiting.

Oxygen was injected into a molten metal bath. The oxygen was ejected from the lance tip through a nozzle having an exit diameter of 0.807 inch. The lance tip was positioned 28 inches above the surface of the molten metal and at a 40 degree angle to the horizontal so that the oxygen jet passed through a distance of 43 inches or 53 nozzle diameters from the lance tip to the molten metal surface. The main gas was enveloped in a flame envelope from the lance tip to the molten metal surface and had an initial jet axis velocity of 1600 fps and maintained this jet axis velocity when it impacted the molten metal surface. About 85 percent of the oxygen ejected from the lance entered the molten metal pool and became available to react with constituents of the molten metal. About 367 standard cubic feet per hour (SCFH) per ton of molten metal of oxygen was needed to burn out about 20 pounds of carbon per ton of the molten metal compared with about 558 SCFH of oxygen per ton of molten metal which was required for the same amount of carbon removal but using conventional gas provision practice.

Although the invention has been described in detail with reference to certain embodiments, those skilled in the art will recognize that there are other embodiments of the invention within the spirit and the cope of the claims.

We claim:

1. A method for introducing gas into a liquid pool comprising:

(A) ejecting gas from a lance having a converging/diverging nozzle with an exit diameter (d) and having a tip spaced from the surface of the liquid pool, and forming a gas stream having a supersonic initial jet axis velocity upon ejection from the lance tip;

(B) surrounding the gas stream with a flame envelope having a velocity less than that of the gas stream, passing the gas stream from the lance tip to the liquid pool surface through a distance of at least 20d, and contacting the liquid pool surface with the gas stream having a supersonic jet axis velocity; and (C) passing gas from the gas stream through the surface of the liquid pool and into the liquid pool.

2. The method of claim 1 wherein the gas comprises oxygen.

3. The method of claim 1 wherein the gas comprises nitrogen.

4. The method of claim 1 wherein the gas comprises argon.

5. The method of claim 1 wherein the gas comprises carbon dioxide.

6. The method of claim 1 wherein the gas comprises hydrogen.

7. The method of claim 1 wherein the gas comprises hydrocarbon gas.

8. The method of claim 1 wherein the gas comprises air.

9. The method of claim 1 wherein the liquid pool comprises molten metal.

10. The method of claim 1 wherein the liquid pool comprises an aqueous liquid.

11. The method of claim 1 wherein the flame envelope extends from the lance tip to the liquid pool surface.

12. The method of claim 1 further comprising forming a gas cavity within the liquid pool and bubbling gas into the liquid from said gas cavity.

13. The method of claim 1 further comprising forming a plume of rising bubbles within the liquid pool comprised of gas which enters the liquid pool.

14. The method of claim 13 further comprising forming a mound on the surface of the liquid pool by the action of the plume of rising bubbles.

15. The method of claim 1 wherein the gas comprises oxygen, the liquid pool comprises molten metal, the nozzle exit diameter is within the range of from 0.5 to 2.0 inches, and the distance the gas stream travels from the lance tip to the liquid pool surface is within the range of from 20d to 100d.

16. The method of claim 1 wherein the gas comprises argon, the liquid pool comprises molten metal, the nozzle exit diameter is within the range of from 0.5 to 2.0 inches, and the distance the gas stream travels from the lance tip to the liquid pool surface is within the range of from 20d to 100d.

17. The method of claim 1 wherein the flame envelope also serves to provide significant heat into the volume above the surface of the liquid pool so that the lance also functions as a burner.

* * * * *